United States Patent [19]

Ivory et al.

[11] 4,392,261

[45] Jul. 12, 1983

[54] BABY CRADLE

[75] Inventors: Loretta C. Ivory, 6263 S. Niagara Way, Englewood, Colo. 80111; Frederick D. Hartmann, Aurora, Colo.

[73] Assignee: Loretta C. Ivory, Englewood, Colo.

[21] Appl. No.: 216,805

[22] Filed: Dec. 16, 1980

[51] Int. Cl.[3] ..... A47D 9/00

[52] U.S. Cl. ..... 5/101; 5/109

[58] Field of Search ..... 5/105–107; 297/258, 261, 272

[56] References Cited

U.S. PATENT DOCUMENTS

| | | | |
|---|---|---|---|
| 190,417 | 5/1877 | Bushong | 5/105 |
| 855,551 | 6/1907 | Avara | 5/105 |
| 1,352,836 | 4/1919 | Runne | 297/258 |
| 1,722,408 | 7/1929 | Brabec | 5/105 |
| 2,417,618 | 3/1947 | Scott | 5/105 |
| 3,890,660 | 6/1975 | Pedler | 5/105 |
| 4,241,949 | 12/1980 | Parker | 297/258 |

*Primary Examiner*—Ramon S. Britts
*Assistant Examiner*—Michael F. Trettel
*Attorney, Agent, or Firm*—Gregg I. Anderson

[57] ABSTRACT

A baby cradle supported on a pair of longitudinal rockers providing for head to toe rocking of a baby. When the cradle is not being rocked, as in an equilibrium position, the rockers maintain the cradle in such a position that a baby lying in the cradle is at all times head up relative to the feet.

9 Claims, 4 Drawing Figures

BABY CRADLE

BACKGROUND OF THE INVENTION

1. Field of the Invention

The present invention relates to baby cradles and more particularly baby cradles of the type that rock a baby from head to toe rather than from side to side.

2. Description of the Prior Art

Baby cradles have almost exclusively used transverse rockers to rock a baby from side to side. A few cradles, though primarily envisioned as rocking a baby from side to side, have been adaptable to head to toe rocking by longitudinally aligning the cradle and the rockers.

One cradle that can be converted from side to side to head to toe rocking is shown in U.S. Pat. No. 55,401 to J. B. Warren. In the normal manner, the Warren cradle rocks a baby from side to side. Longitudinal rocking, from head to toe, occurs by pivoting the cradle on the rocker into a longitudinally aligned relationship between the cradle and the rockers. Warren goes on to explain how certain panels can be removed from the cradle configuration so that a chair is formed and the baby has in essence a rocking chair. The cradle of Warren is therefore not intended to be used as a cradle while rocking head to toe.

A rocking cradle shown in U.S. Pat. No. 190,417 to I. Bushong does show a longitudinally rocking cradle that is used as a cradle in the longitudinally aligned mode. Again, the cradle itself is pivotal about the rockers through a tightening screw. A slot in the bottom panel of the cradle would allow longitudinal adjustment of the cradle relative to the rockers. The cradle of Bushong utilizes the slot in the cradle to move the cradle longitudinally with respect to the rockers. A baby rocking head to toe will not end up in a head down position after rocking ceases, provided the cradle has been properly adjusted and the baby does not move and change the longitudinal center of gravity of the cradle. A baby lying head down is undesirable. Vomiting or spitting up food can clog airways that might clear if the baby were head up.

Both Warren and Bushong utilize rockers that are symmetric about a plane transverse to the length of the cradle and rockers. Warren is not concerned with maintaining a head up position during head to toe rocking because the main purpose is in having a rocking chair. Bushong, though concerned about keeping a baby's head up, does not insure that that baby cannot reach a head down position by slippage of the cradle or by placement or movement of the baby away from the adjusted position.

It has only recently come to light that babies, particularly premature babies, rocked from head to toe have more complete neurological development at six months than babies not rocked head to toe. Head to toe rocking is more similar to the movement a fetus experiences while in the mother's womb. Typical of such studies is one performed by Dr. Ruth Rice of the University of Houston. Such studies were not available when the patents to Warren and Bushong were issued before the turn of this century and were therefore not taken into consideration in those cradles.

SUMMARY AND OBJECTS OF THE INVENTION

The principal object of the present invention is to provide a cradle that rocks a baby from head to toe.

A related object of the present invention is to provide a cradle that, regardless of the position of a sleeping baby within the cradle, holds the baby's head up relative to the baby's feet, or at least level.

In accordance with the objects of the invention, a cradle has a bottom panel and an upwardly extending head panel, foot panel and side panels. The cradle is thus of three-dimensional, generally hollow rectangular configuration having an opening in the top. Handles are provided at the foot panel and head panel so that a rocking motion can be induced or halted. A baby is placed approximately in the middle of the cradle with the head nearer the head panel.

The side rockers are integral to and coplanar with the side panels, extending below the bottom panel to contact a rigid floor surface. A curvilinear surface is defined by each rocker which curvilinear surface extends from a point of connection between the side panel, bottom panel and the foot panel to a point of connection between the side panel, bottom panel and the head panel at the head of the cradle. The curvilinear surface is defined in terms of perpendicular distances from the bottom panel along the length of the bottom panel. Beginning at the foot panel end of the curvilinear surface, the perpendicular distances gradually increase to a maximum distance approximately two-thirds of the way along the length of the bottom panel.

At the maximum perpendicular distance from the bottom panel to the curvilinear surface, a fulcrum point is established. This fulcrum point is past the longitudinal center of gravity of the cradle. The nearer to the head panel a baby is placed in the cradle, the more the longitudinal center of gravity of the cradle moves toward the fulcrum point. The fulcrum point is set at a length away from the head panel corresponding generally to half of the length of a baby, the approximate distance at which the longitudinal center of gravity of the baby would act. Thus, wherever the longitudinal center of gravity is moved by the positioning of the baby, in no event would it move to the head side of the fulcrum point.

From the fulcrum point to the head panel, the perpendicular distance from the bottom panel to the curvilinear surface again decreases, until the head panel is reached. Though the portion of the curvilinear surface between the fulcrum point and the head panel is available for rocking, when the cradle is in an equilibrium position, the longitudinal center of gravity would act along a line perpendicular to the floor surface intersecting the curvilinear surface at some position between the foot panel and the fulcrum point. In this manner the baby is maintained in a head up position when the cradle is not rocking.

DESCRIPTION OF THE PREFERRED EMBODIMENTS

Figure 1:
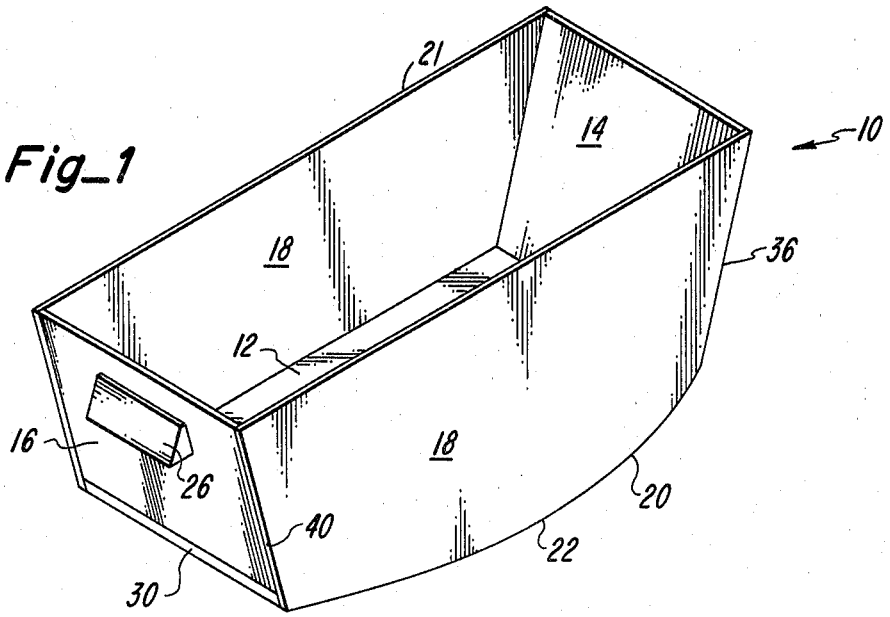
FIG. 1 is a perspective view of the cradle of the invention.
Figure 4:
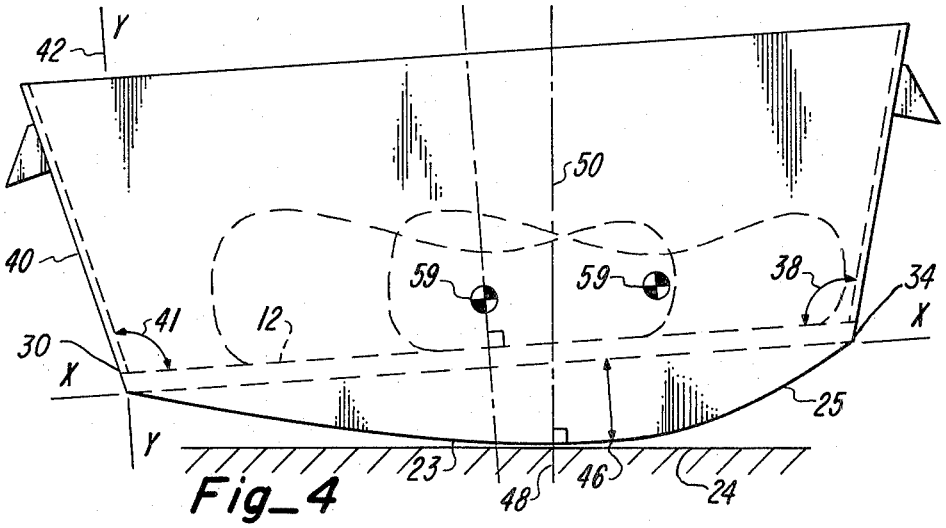
FIG. 4 is a side elevational view of the invention shown in FIG. 1 with a set of Cartesian coordinant axes located at a point of connection between a side panel and bottom panel of the cradle.

As seen in FIG. 1, a cradle 10 for premature or full-term babies is constructed from a rectangular bottom panel 12 with a head panel 14, a foot panel 16 and a pair of side panels 18 all extending upwardly therefrom to form a generally open-topped box-shaped body 21. A pair of rockers 20, integral with the side panels, extend downwardly to terminate in a curvilinear surface or support means 22 which rest upon a floor surface 24. A handle 26 is mounted on the foot panel and head panel respectively. A baby is laid in the cradle oriented so that the baby's head is nearer the head panel and the baby's body is parallel to the side panels (FIG. 4).

Figure 2:
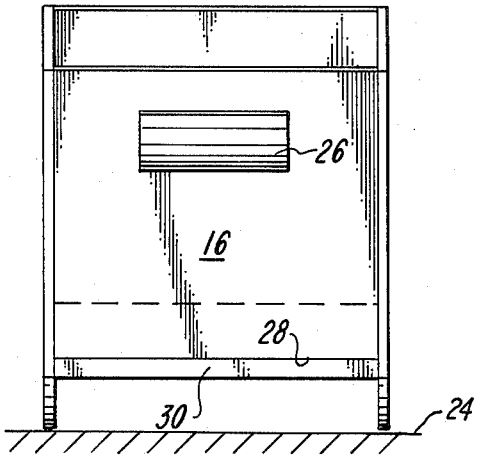
FIG. 2 is an end view of the foot panel end of the invention shown in FIG. 1.
Figure 3:
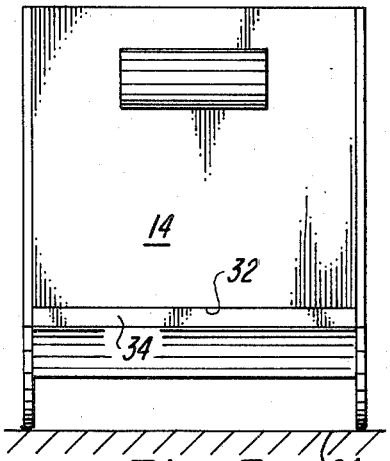
FIG. 3 is an end view of the head panel end of the invention shown in FIG. 1.

The foot panel 16 is of generally rectangular configuration and joins along a bottom edge 28 thereof to one end 30 of the bottom panel 12 by glueing or any suitable connection means (FIG. 2). In like manner, the rectangular head panel 14 is joined along a bottom edge 32 to a second end 34 of the bottom panel (FIG. 3).

The side panels 18 are joined to the head panel 14, foot panel 16 and bottom panel 12 in a similar conventional manner. The side panels each have a forward edge 36 making an obtuse angle 38 (FIG. 4) with the bottom panel and extending upwardly therefrom. A rear edge 40 of the side panels 18 forms a second obtuse angle 41 with the bottom panel. When assembled as described, an open topped rectangular body results. The rockers 20 extend below the bottom panel to contact the floor surface 24 along curvilinear surface 22.

A baby placed on the bottom panel 12 can be rocked by merely grasping one of the handles 26 and moving the handle up or down. The curvilinear surface 22 describes a rocking motion, which is transferred to the baby upon an individual exerting an up or down force on the handles. Because the rocker surfaces 20 run longitudinally and below the side panels 18, this rocking motion is a head to toe motion to the baby. Such a motion has been determined to have beneficial effects, particularly on premature babies, whose neurological systems are not fully developed when they are born. The head to toe motion simulates the motion a fetus experiences while being carried in a mother's womb.

The curvilinear surface 22 of the rockers 20 is uniquely defined not only to impart the head to toe rocking motion to the baby, but also to maintain a baby in an at all times head up position relative to the feet when the cradle 10 is at equilibrium. In further describing the curvilinear surface 22 reference will be made to Cartesian coordinant system 42 lying in the plane of one of the side panels 18 with an origin located at end 30 of the bottom panel 12 with the horizontal or X axis extending along the bottom of the bottom panel (FIG. 4).

Curvilinear surface 22 starts at the origin of coordinant system 42 and moves longitudinally toward a termination point at a connection point between side panel 18 and bottom panel 12 at end 34. The curve is defined by perpendicular distances from X or horizontal axis of the coordinant system 42. These perpendicular distances increase along the length of the bottom panel 12, whose total length would be about 30 inches for a premature baby, to a point at approximately 20 inches from the origin of the coordinant system where the longest perpendicular is located.

The longest perpendicular defines a fulcrum point 46 on the curvilinear surface. From the origin of coordinant system 42 to the fulcrum point 46, curvilinear surface 22 has a first curved portion 23 having relatively little curvature that has at all times a negative slope. A baby lying on the bottom panel 12 is lying at essentially zero slope relative to coordinant axes 42. The difference between the zero slope of the bottom panel and the slope of the curvilinear surface, at any given point where curvilinear surface 22 contacts floor surface 24, provides for the rocking motion of the cradle 10. When the cradle 10 is at rest on first curved portion 23, the difference in slope keeps the baby's head up (FIG. 4).

From the fulcrum point 46 to the termination of the curvilinear surface 22 at the head panel 14, the perpendicular distance between the bottom panel 12 and the curvilinear surface decreases. At the fulcrum point, a line tangent to the fulcrum point has zero slope. From the fulcrum point on to the head panel 14 at end 34 of bottom panel 12, the curvilinear surface has a second rounded curved portion 25 of positive slope. Again, in a rocking motion, the difference between the zero slope of the baby lying on the bottom panel and the positive slope of the curvilinear surface beyond the fulcrum point allows for head to toe rocking of the cradle 10.

The location of the fulcrum point 46 is important to the overall operation of the cradle 10, particularly in terms of keeping the baby's head up when the cradle is at rest, or in equilibrium. When the cradle is in equilibrium, an equilibrium point 48 (FIG. 4) is defined by the point on curvilinear surface 22 to which the floor surface 24 is tangent. It is important that the equilibrium point always be located along first curved portion 23. At this equilibrium position, a line 50, perpendicular to the floor 24 and passing through the equilibrium point 48 will, by definition, pass through the center of gravity of the cradle 10 and baby.

With the baby removed, the equilibrium point 48 is always in the negative slope of the first curved portion of the curvilinear surface 22 because the length of the negative slope portion of the curve extends beyond the center of gravity of the cradle. In the preferred embodiment, the body 21 defined by the side panels 18, foot panel 16, bottom panel 12 and head panel 14 is essentially symmetrical about a plane transverse to the length of the cradle, and therefore, the center of gravity component of the cradle alone acts at line 50, very near half the cradle's length. The curvilinear surface 22 of the rockers 20 is asymmetric about this transverse plane, which plane passes through a midpoint of the length of the bottom panel 12.

If a baby is placed approximately in the middle of the cradle, the center of gravity component of the baby is virtually the same as the cradle's center of gravity and therefore intersects the curvilinear surface 22 in the negative slope first curved portion 23. The equilibrium point 48 is again to the negative slope area (FIG. 4). Thus the baby is always maintained in a head up position because of the negative slope of curvilinear surface 22 at equilibrium point 48. This is extremely important in newborn babies, which cannot turn over to relieve air passages that may be clogged by vomit or regurgitations.

If the baby is placed as near as possible to the head panel 14 (FIG. 4), a center of gravity component 59 contributed by the baby would move the center of gravity of the cradle 10 toward the fulcrum point 46. The baby's weight is not great in comparison to the cradle 10 and the center of gravity for the baby and cradle combined will not vary far from the center of gravity of the cradle alone. Even though the center of gravity of the baby and cradle is moved by positioning the baby as near as possible to the head panel 14, it cannot move beyond the fulcrum point 46. In the worse case situation, the baby's center of gravity 59 acts virtually through the fulcrum point and does not contribute a moment to the cradle sufficient to establish an equilibrium point 48 along second curved portion 25.

As can be seen from Table I, in the preferred embodiment for a premature baby, the following set of points, measured in inches, define the curvilinear surface 22 with reference to coordinant system 42.

TABLE I

| X Coordinant | Y Coordinant |
|---|---|
| 0 | 0 |
| 2 | $-\frac{3}{8}$ |
| 4 | $-1$ |
| 6 | $-1\frac{3}{8}$ |
| 8 | $-1\frac{3}{4}$ |
| 10 | $-2\frac{1}{4}$ |
| 12 | $-2$ 11/16 |
| 14 | $-3$ |
| 16 | $-3$ 3/16 |
| 18 | 3 5/16 |
| 20 | $-3\frac{3}{8}$ |
| 22 | $-3$ 5/16 |
| 24 | $-3$ 15/16 |
| 26 | $-2$ 5/16 |
| 28 | $-1\frac{1}{4}$ |
| 30 | 0 |

As can be seen from the table, the fulcrum point 46 lies at the point 20 inches from the end 30 of bottom panel 12, $3\frac{3}{8}$ inches below bottom panel 12. The fulcrum point is thus approximately ten inches from the head panel 14, which is approximately half the length of a premature baby and approximately where the center of gravity component of the baby would act. Thus, even with the baby as close as possible to the head panel 14, the combined center of gravity of the baby and cradle 10 will not move beyond fulcrum point 46 and thereby establish an equilibrium point 48 along the positive slope of second curved portion 25.

A full understanding of how applicant's invention maintains a premature baby in a head up position at equilibrium is best understood from the following example.

EXAMPLE 1

A baby cradle 10 having a curvilinear surface 22 as defined in Table I weighs approximately 22 pounds. The smallest baby that might be expected to use the cradle would be approximately 17 inches in length and weight about five pounds. The baby's center of gravity would act at about one-third of the baby's length from its head or about 5.7 inches from the top of the baby's head.

The moment attributable to the cradle is computed by assuming that the weight of the cradle acts at its center of gravity, approximately the half way point of the cradle's length, or 15 inches from the origin of coordinant axis 42 and five inches from the fulcrum point. The cradle moment therefore equals $5\times22=110$ inch pounds.

The moment attributable to the baby is computed by assuming that the baby's weight acts entirely through its center of gravity, the baby's head being against head panel 14. The center of gravity of the baby is therefore 24.3 inches from the origin of coordinant axis 42 or 4.3 inches from the fulcrum point. The moment due to the baby is therefore equal to $4.3\times5=21.5$ inch pounds.

From the foregoing example it can be seen that because of the construction of curvilinear surface 22 and the location of the fulcrum point 46, the moment due to the weight of the cradle would act at all times in a counterclockwise direction about the fulcrum point. Therefore, the moment due to the weight of the cradle tends to come to an equilibrium point 48 that lies along the first curved portion 23 of curvilinear surface 22. This is the desired position to maintain a baby in a head up position.

The moment contributed by a baby lying with his head as near as possible to the head panel 14 acts in a clockwise direction about the fulcrum point 46. The baby therefore tends to move the cradle toward the second curved portion 25 of curvilinear surface 22. Because the moment contributed by the baby is substantially less than that created by the cradle itself, the cradle and baby will tend to come to an equilibrium position along the first curved portion 23, resulting in a head up position for a baby.

Table II represents a curvilinear surface 22 for a cradle 10 for an alternative embodiment for a larger full-term baby, again with reference to coordinant system 42.

TABLE II

| X Coordinant | Y Coordinant |
|---|---|
| 0 | 0 |
| 2 | $-\frac{3}{4}$ |
| 4 | $-1\frac{1}{2}$ |
| 6 | $-2$ 1/16 |
| 8 | $-2$ 11/16 |
| 10 | $-3\frac{1}{4}$ |
| 12 | 3 11/16 |
| 14 | $-4\frac{1}{8}$ |
| 16 | $-4$ 7/16 |
| 18 | $-4\frac{5}{8}$ |
| 20 | $-4$ 13/16 |
| 22 | $-4\frac{7}{8}$ |
| 24 | $-4$ 13/16 |
| 26 | $4\frac{5}{8}$ |
| 28 | $4\frac{1}{4}$ |
| 30 | $-3\frac{7}{8}$ |
| 32 | $-2\frac{7}{8}$ |
| 34 | $-\frac{1}{2}$ |
| 36 | 0 |

For the larger full-term baby, the fulcrum point appears at 22 inches from the origin of coordinant axis 42. The cradle 10 is slightly larger to accommodate the larger full-term baby and therefore the fulcrum point has been moved along the X coordinant axis away from the origin or coordinant axes 42.

Application of the curvilinear surface 22 defined in Table II will be better understood by reference to the following example.

EXAMPLE 2

A baby cradle 10 having a curvilinear surface 22 as defined in Table II weighs approximately 25 pounds. The smallest baby that might be expected to use the cradle would be approximately 20 inches in length and weight about 7.5 pounds. The baby's center of gravity would act at about one-third of the baby's length from its head or about 6.7 inches from the top of the baby's head.

The moment attributable to the cradle is computed by assuming that the weight of the cradle acts at its center of gravity, approximately the half way point of the cradle's length, or 18 inches from the origin of coordinant axis 42 and four inches from the fulcrum point. The cradle moment therefore equals $4\times25=100$ inch pounds.

The moment attributable to the baby is computed by assuming that the baby's weight acts entirely through its center of gravity, the baby's head being against head panel 14. The center of gravity of the baby is therefore 29.3 inches from the origin of coordinant axis 42 or 7.3 inches from the fulcrum point. The moment due to the baby is therefore equal to $7.3\times7.5=54.8$ inch pounds.

As was the case in Example 1, the moment attributable to the baby cradle is almost a factor of two times greater than the moment attributable to the baby. The moment of the baby cradle 10 therefore acts to maintain the equilibrium point 48 along the first curved portion 23 of curvilinear surface 22, which in turn keeps the baby in a head up position.

Curvilinear surface 22 can be reproduced based on the curve of Table II for any desired length baby cradle 10. A direct ratio is made between the desired length and the 36 inch cradle. The X coordinate spacing is the product of 2 inches, the X coordinate spacing for a 36 inch cradle, and the direct ratio. Each Y coordinate is generated by taking the Y coordinate associated with each spacing on the 36 inch cradle of Table II and multiplying that Y coordinate by the direct ratio. In this manner the curvilinear surface that keeps the baby head up can be transferred to any desired length of cradle.

In either the premature or full-term baby, as the baby gets larger the weight increases. The length of the baby also increases and therefore the center of gravity of the baby moves closer to the fulcrum point 46 so that the total moment about fulcrum point 46 never is sufficient to exceed the moment created by the cradle 10.

The baby of course must be placed in the cradle with the head of the baby nearest the head panel 14. The side panels 18 of the cradle are placed sufficiently close together so that a baby could not turn from end to end and get into a position where the baby's head is nearest the foot panels 16.

Though the invention has been described with a certain degree of particularity, nothing contained herein shall be construed to limit the scope of the above described invention, particularly as defined in the appended claims.

What we claim is:

1. In a cradle for a baby lying in a preselected orientation wherein the baby's head is nearer a head panel of said cradle, said cradle further having two longitudinally extending side panels and a foot panel, said foot panel and head panel are connected to the side panel, the side panels, foot panel and head panel are connected along a bottomost edge to a bottom panel and to each other, the cradle being adapted to rock on a floor surface, the improvement comprising:

support means for said cradle integral to each of said side panels and having a longitudinally extending curvilinear surface for rocking said cradle in a longitudinal plane on said floor surface, said support means connected to said cradle, said curvilinear surface being asymmetric with respect to a transverse plane through a midpoint of the length of the cradle whereby said baby lies in said cradle in a head up position relative to the baby's feet when the cradle is in equilibrium regardless of the longitudinal position of the baby within said cradle.

2. The invention as defined in claim 1 wherein said curvilinear surface further include:

a first curved portion having little curvature extending longitudinally beneath said cradle from said foot panel toward said head panel terminating at a predetermined distance beyond the center of gravity of said cradle;

a fulcrum point at the termination of said first curved portion, a line tangent to said fulcrum point lying parallel to the bottom panel of said cradle; and a second curved portion extending from said fulcrum point to the head panel of said cradle.

3. A baby cradle comprising in combination:

a generally open topped box-shaped body into which a baby is placed with the baby's head toward one end of said body, said body supported on a floor surface by curvilinear support means integrally mounted to said body for defining a head to toe rocking motion to said cradle upon a force being imparted to said cradle, said curvilinear support means further having equilibrium positions along a portion of the length thereof, said equilibrium positions positioned along said curvilinear surface so that a baby is held head up relative to the baby's feet regardless of where along the length of the cradle the baby is placed.

4. A baby cradle for rocking a baby, said baby placed in said cradle, comprising in combination:

a bottom panel having two relatively elongated parallel sides and two relatively short parallel ends;

a side panel connected along a bottommost edge to each side of said bottom panel;

a foot panel connected at a bottommost edge to one end of the bottom panel;

a head panel connected at a bottommost edge to the other end of the bottom panel, said baby positioned longitudinally in said cradle with the baby's head nearer said head panel than said foot panel; and curvilinear support means for rocking said baby from head to toe and for maintaining said baby in a head up position relative to the feet when said cradle is not rocking, said curvilinear support means further including:

(a) a first curved portion having little curvature extending from the connection between the bottom panel and the foot panel in a plane of the side panel, said first curved portion extending at ever increasing perpendicular distances from said bottom panel along the length of said bottom panel to a fulcrum point beyond the longitudinal center of gravity of said cradle and said baby, said fulcrum point defined at a maximum perpendicular distance from said bottom panel; and (b) a second curved portion having a relatively greater curvature than said first curved portion extending from said fulcrum point to said connection between said bottom panel and said head panel in the plane of said side panel, at an ever decreasing perpendicular distance from said bottom panel.

5. A baby cradle weighing between 22 and 25 pounds and generally symmetric about a transverse plane halfway along the length of the cradle, said cradle receiving a baby in a predetermined orientation comprising in combination:

a bottom panel;

a side panel connected along a bottommost edge to either side of the bottom panel;

a foot panel connected along a bottommost edge to the bottom panel;

a head panel connected along a bottommost edge to the bottom panel;

a rocker having a curved surface mounted to said cradle beneath said bottom panel, said rocker supporting said cradle on a floor surface, said curved surface generally following a curve established by points set on a Cartesian coordinant system whose origin is at the connection between the bottom panel and the foot panel, a horizontal axis of said coordinant system lying along one side of said bottom panel and a vertical axis of said coordinant system perpendicular to said horizontal axis and said bottom panel in a plane parallel to a longitudinal plane through said baby cradle, a set of points tabulated in inches of lineal measurement defining said curved surface as follows:

| Horizontal Axis Coordinant | Vertical Axis Coordinant |
|---|---|
| 0 | 0 |
| 2 | $-\frac{3}{8}$ |
| 4 | $-1$ |
| 6 | $-1\frac{3}{8}$ |
| 8 | $-1\frac{3}{4}$ |
| 10 | $-2\frac{1}{4}$ |
| 12 | $-2$ 11/16 |
| 14 | $-3$ |
| 16 | $-3$ 3/16 |
| 18 | 3 5/16 |
| 20 | $-3\frac{3}{8}$ |
| 22 | $-3$ 5/16 |
| 24 | $-3$ 15/16 |
| 26 | $-2$ 5/16 |
| 28 | $-1\frac{1}{4}$ |
| 30 | 0, |

whereby said curved surface maintains said cradle containing said baby in a head up position relative to the feet when the cradle in in equilibrium.

6. A baby cradle weighing between 22 and 25 pounds and generally symmetric about a transverse plane halfway along the length of the cradle, said cradle receiving a baby in a predetermined orientation comprising in combination:

a bottom panel;

a side panel connected along a bottommost edge to either side of the bottom panel;

a foot panel connected along a bottommost edge to the bottom panel;

a head panel connected along a bottommost edge to the bottom panel;

a rocker having a curved surface mounted to said cradle beneath said bottom panel, said rocker supporting said cradle on the floor surface, said curved surface generally following a curve established by points set on a Cartesian coordinant system whose origin is at the connection between the bottom panel and the foot panel, a horizontal axis of said coordinant system lying along one side of said bottom panel and a vertical axis o said coordinant system perpendicular to said horizontal axis and said bottom panel in a plane parallel to a longitudinal plane through said baby cradle, a set of points tabulated in inches of lineal measurement defining said curved surface as follows:

| Horizontal Axis Coordinant | Vertical Axis Coordinant |
|---|---|
| 0 | 0 |
| 2 | $-\frac{3}{4}$ |
| 4 | $-1\frac{1}{2}$ |
| 6 | $-2$ 1/16 |
| 8 | $-2$ 11/16 |
| 10 | $-3\frac{1}{4}$ |
| 12 | $-3$ 11/16 |
| 14 | $-4\frac{1}{8}$ |
| 16 | $-4$ 7/16 |
| 18 | $-4\frac{5}{8}$ |
| 20 | $-4$ 13/16 |
| 22 | $-4\frac{7}{8}$ |
| 24 | $-4$ 13/16 |
| 26 | $-4\frac{5}{8}$ |
| 28 | $-4\frac{1}{4}$ |
| 30 | $-3\frac{7}{8}$ |
| 32 | $-2\frac{7}{8}$ |
| 34 | $-\frac{1}{2}$ |
| 36 | 0, |

whereby said curved surface maintains said cradle containing said baby in a head up position relative to the feet when the cradle is in equilibrium.

7. A baby cradle generally symmetric about a transverse plane halfway along the length of the cradle, said cradle receiving a baby in a predetermined orientation comprising in combination:

a bottom panel;

a side panel connected along a bottommost edge to either side of the bottom panel;

a foot panel connected along a bottommost edge to the bottom panel;

a head panel connected along a bottommost edge to the bottom panel;

a rocker having a curved surface mounted to said cradle beneath said bottom panel, said rocker supporting said cradle on the floor surface, said curved surface generally following a curve established by points set on a Cartesian coordinant system, the coordinant of each point multiplied by a ratio defined by the desired length of the bottom panel divided by 36, the origin of the coordinant system is at the connection between the bottom panel and the foot panel, a horizontal axis of said coordinant system lying along one side of said bottom panel and a vertical axis of said coordinant system perpendicular to said horizontal axis and said bottom panel in a plane parallel to a longitudinal plane through said baby cradle, a set of points tabulated in inches of lineal measurement defining said curved surface as follows:

| Horizontal Axis Coordinant | Vertical Axis Coordinant |
|---|---|
| 0 | 0 |
| 2 | $-\frac{3}{4}$ |
| 4 | $-1\frac{1}{2}$ |
| 6 | $-2$ 1/16 |
| 8 | $-2$ 11/16 |
| 10 | $-3\frac{1}{4}$ |
| 12 | $-3$ 11/16 |
| 14 | $-4\frac{1}{8}$ |
| 16 | $-4$ 7/16 |
| 18 | $-4\frac{5}{8}$ |
| 20 | $-4$ 13/16 |
| 22 | $-4\frac{7}{8}$ |
| 24 | $-4$ 13/16 |
| 26 | $-4\frac{5}{8}$ |
| 28 | $-4\frac{1}{4}$ |
| 30 | $-3\frac{7}{8}$ |
| 32 | $-2\frac{7}{8}$ |

-continued

| Horizontal Axis Coordinant | Vertical Axis Coordinant |
|---|---|
| 34 | $-\frac{1}{2}$ |
| 36 | 0, |

whereby said curved surface maintains said cradle containing said baby in a head up position relative to the feet when the cradle is in equilibrium.

8. A baby cradle having an open-topped box-shaped body which receives a baby in an orientation wherein the head of the baby is near one end of the body and the feet are nearer another end of the body, said body supported on a floor surface by support means integrally connected to said body and having a curvilinear surface with a constantly changing curvature from the one end to the other end of the body, said curvature sloping downwardly from the other end of the body and then upwardly to join the one end of the body, the downward curvature of said curvilinear surface always contacting the floor surface when the cradle is at equilibrium.

9. A baby cradle having longitudinally extending and fixedly positioned rockers, said rockers having a curvilinear surface which contacts a floor surface, said curvilinear surface defined so that a first moment about a center of gravity of the cradle is always greater than a second moment about a center of gravity of a baby placed in a predetermined orientation within the cradle, whereby said baby is always held in a head up position relative to the baby's feet.

* * * * *